US012595593B2

(12) United States Patent
Zhang et al.

(10) Patent No.: US 12,595,593 B2
(45) Date of Patent: Apr. 7, 2026

(54) PREPARATION METHOD OF AEROGEL FIBER AND USE

(71) Applicant: INSTITUTE OF NANO-TECH AND NANO-BIONICS (SINANO), CHINESE ACADEMY OF SCIENCES, Suzhou (CN)

(72) Inventors: Xuetong Zhang, Suzhou (CN); Zengwei Liu, Suzhou (CN)

(73) Assignee: SUZHOU INSTITUTE OF NANO-TECH AND NANO-BIONICS (SINANO), CHINESE ACADEMY OF SCIENCES, Suzhou (CN)

( * ) Notice: Subject to any disclaimer, the term of this patent is extended or adjusted under 35 U.S.C. 154(b) by 145 days.

(21) Appl. No.: 18/574,054

(22) PCT Filed: Apr. 13, 2023

(86) PCT No.: PCT/CN2023/087977
§ 371 (c)(1),
(2) Date: Dec. 25, 2023

(87) PCT Pub. No.: WO2024/159627
PCT Pub. Date: Aug. 8, 2024

(65) Prior Publication Data

US 2025/0101637 A1 Mar. 27, 2025

(30) Foreign Application Priority Data

Feb. 3, 2023 (CN) ..... 202310054875.9

(51) Int. Cl.
*D01D 5/247* (2006.01)
*D01D 1/02* (2006.01)
(Continued)

(52) U.S. Cl.
CPC ..... *D01D 5/247* (2013.01); *D01D 1/02* (2013.01); *D01D 5/04* (2013.01); *D01D 10/02* (2013.01);
(Continued)

(58) Field of Classification Search
None
See application file for complete search history.

(56) References Cited

U.S. PATENT DOCUMENTS 11,857,937 B2 * 1/2024 Wu ..... C04B 14/302
2012/0215148 A1 * 8/2012 Ewert ..... D01F 2/00 264/103
(Continued)

FOREIGN PATENT DOCUMENTS

CN 110468461 A 11/2019
CN 111646816 A 9/2020
(Continued)

OTHER PUBLICATIONS

Senping Liu, et al., High-Speed Blow Spinning of Neat Graphene Fibrous Materials, Nano Letters, 2021, pp. 5116-5125, vol. 21, American Chemical Society.
(Continued)

*Primary Examiner* — Emmanuel S Luk
(74) *Attorney, Agent, or Firm* — Bayramoglu Law Offices LLC

(57) ABSTRACT

A preparation method of an aerogel fiber and use are provided. The preparation method includes: mixing a solvent and a polymer material to form a spinning solution; driving the spinning solution with a high-speed airflow by using a blow spinning technology to form a jet flow, and forming a gel fiber through sol-gel transition; and performing solvent replacement on the gel fiber and then performing drying treatment to prepare the aerogel fiber. The method for
(Continued)

preparing the aerogel fiber through blow spinning has no high requirements on a gelation process of an aerogel material, and can achieve the preparation of the aerogel fiber by using this method after the spinning solution meeting rheological conditions is obtained, thereby avoiding the influence of the inadequate gelation process on fiber properties while promoting the production efficiency of the aerogel fiber and greatly simplifying procedures.

15 Claims, 2 Drawing Sheets

(51) Int. Cl.
*D01D 5/04* (2006.01)
*D01D 10/02* (2006.01)

(52) U.S. Cl.
CPC ..... *D10B 2201/30* (2013.01); *D10B 2321/06* (2013.01); *D10B 2321/08* (2013.01); *D10B 2331/021* (2013.01); *D10B 2401/10* (2013.01)

(56) References Cited

U.S. PATENT DOCUMENTS

| | | | | |
|---|---|---|---|---|
| 2014/0162063 | A1* | 6/2014 | Dzenis | D01D 5/0092 428/401 |
| 2016/0024278 | A1* | 1/2016 | Fricke | D01D 1/02 523/218 |
| 2018/0044187 | A1* | 2/2018 | Pico | D21H 13/40 |
| 2021/0213411 | A1 | 7/2021 | Wu et al. | |
| 2023/0212789 | A1* | 7/2023 | Zhang | B33Y 10/00 428/319.7 |
| 2023/0227724 | A1* | 7/2023 | Andrejcak | C03C 25/146 442/136 |

FOREIGN PATENT DOCUMENTS

| | | | | | |
|---|---|---|---|---|---|
| CN | 112456476 | A | | 3/2021 | |
| CN | 113403707 | A | | 9/2021 | |
| CN | 113463375 | A | | 10/2021 | |
| CN | 114481680 | A | | 5/2022 | |
| CN | 120350438 | A | * | 7/2025 | C08B 1/003 |
| IL | 296729 | A | * | 11/2022 | C01B 33/1585 |
| JP | S53119323 | A | | 10/1978 | |
| JP | S5482428 | A | | 6/1979 | |
| JP | H05186910 | A | | 7/1993 | |
| JP | 2016176158 | A | | 10/2016 | |
| KR | 100416134 | B1 | * | 1/2004 | B01D 69/087 |
| WO | WO-2023128928 | A1 | * | 7/2023 | C01B 33/1585 |
| WO | 2025040458 | A1 | | 2/2025 | |

OTHER PUBLICATIONS

Marco Lauricella, et al., Models of polymer solutions in electrified jets and solution blowing, Reviews of Modern Physics, 2020, pp. 035004-1-035004-47, vol. 92, No. 3.

John L. Daristotle, et al., A Review of the Fundamental Principles and Applications of Solution Blow Spinning, ACS Applied Materials & Interfaces, 2016, pp. 34951-34963, vol. 8.

* cited by examiner

PREPARATION METHOD OF AEROGEL FIBER AND USE

CROSS REFERENCE TO THE RELATED APPLICATIONS

This application is the national phase entry of International Application No. PCT/CN2023/087977, filed on Apr. 13, 2023, which is based upon and claims priority to Chinese Patent Application No. 202310054875.9, filed on Feb. 3, 2023, the entire contents of which are incorporated herein by reference.

TECHNICAL FIELD

The present application relates to an aerogel material, particularly to a preparation method of a novel aerogel fiber and use, belonging to the technical field of nano porous materials and functional fibers.

BACKGROUND

Accompanied by the common development and progress of human culture and technology, fiber materials become important materials in human production and life. The emergence of synthetic fibers has changed the state where humans have only natural fiber materials such as cotton, hemp and wool for thousands of years, thereby liberating productivity and greatly improving human quality of life. The synthetic fiber is an important achievement in the development of human technology. After nearly 180 years of vigorous development, synthetic fibers have passed the early stage of rapid expansion and entered a refined development stage of pursuing high quality, high performance and high cost-effectiveness. The focus of the development direction of synthetic fibers has shifted from exploring new fiber materials to exploring new fiber structures. Deformed fibers, ultra-fine fibers, and multi-layer functional fibers are all representatives of new structural fibers.

An aerogel material is a new porous material with a three-dimensional nano network structure. Aerogel structurally has high porosity, high specific surface area, ultra-low density and other structural characteristics. The unique structure endows the aerogel material with unique properties such as low thermal conductivity, low dielectric constant, low refractive index and high acoustic impedance. Since the preparation of aerogel in 1931, aerogel materials have shown great application prospects in thermal insulation, aerospace, thermal management of energy storage, adsorption catalysis, sound insulation and other fields. The introduction of an aerogel nano porous network structure into a fiber material should significantly improve the thermal insulation performance of fibers and bring new performance and application direction to fiber materials. However, due to poor mechanical properties, the commercial application forms of aerogel materials are mostly aerogel powders, blocks and aerogel gel composite materials, and a small amount of aerogel films, while the preparation and application of aerogel fibers are rarely reported. The inventor of this case invented the technology of wet spinning to prepare polyamide aerogel fiber earlier and was authorized (CN110468461A). In practical application, it was found that because of a complex mesoporous structure inside the aerogel fiber, the complex spinning, weaving and other processing techniques were used to prepare the aerogel fiber into textiles often damaged its structure and performance. Therefore, the inventor of this case has explored an aerogel fiber preparation technology that can enable the aerogel fiber to bypass the complex processing process and directly apply it to the product, so as to maximize the retention of the structure and performance of the aerogel fiber.

Blow spinning is an emerging non-woven technology. The currently reported blow spinning method specifically refers to a method that high-speed airflow acts on a spinning solution to form a polymer jet flow while evaporating the solvent in the spinning solution and a continuous fiber is formed on the collection device. The resulting fibers are in the form of flocs or non-woven fabrics, which can be directly used as functional materials. Usually, blow spinning equipment includes a high-pressure gas source for transporting a gas and an injection pump for pumping a polymer solution to gather them together to form a stable jet flow jetting device. Blow spinning has unique advantages in the aspect of nanofiber preparation, has simple preparation device, safe preparation process, high preparation speed that is more than ten times that of the traditional electrostatic spinning (Nano Lett, 2021, 21(12): 5116-5125), and good large-scale production potential. The products obtained are in the form of flocs, non-woven fabrics and other products, and can be directly used as products without destructive post-processing process, which is what the existing aerogel fiber preparation technology lacks. However, the existing blow spinning technologies often use low boiling point solvents, a large amount of solvent in the spinning solution is evaporated under the action of airflow, leading to the precipitation of polymer precipitation and the formation of fibers in the spinning solution (Reviews of Modern Physics, 2020, 92 (3): 035004) ACS Applied Materials & Interfaces, 2016, 8 (51): 34951-34963). The fibers prepared by this technology reported today are dense and non-porous precipitation fibers, while the preparation process of aerogel fibers is required to avoid the formation of precipitation to form uniform and stable gel fibers, so it is impossible to directly apply the blow spinning technology to the preparation of aerogel fibers.

There is no report on the preparation of aerogel fiber by blow spinning technology in the existing technical report, and a series of problems such as forming and processing of aerogel fiber need to be solved in the practical application and development of aerogel fiber. Therefore, the present application is hereby submitted.

SUMMARY

The objective of the present application is to provide an aerogel fiber and a preparation method thereof, in order to overcome the defects in the prior art.

Another objective of the present application is to provide use of the above-mentioned aerogel fiber.

To achieve the above-mentioned invention objectives, the technical solution adopted by the present application includes:

An embodiment of the present application provides a preparation method of an aerogel fiber, comprising:

- mixing a solvent with a polymer material to form a spinning solution;
- driving the spinning solution with a high-speed airflow by using a blow spinning technology to form a jet flow, and forming a gel fiber through sol-gel transition; and
- performing solvent replacement on the gel fiber and then performing drying treatment to prepare the aerogel fiber.

An embodiment of the present application also provides the aerogel fiber prepared by the above-mentioned preparation method.

Further, the aerogel fiber is a porous material with a porosity is 60%-99% and a specific surface area of 10-2000 $m^2/g$; the aerogel fiber has a diameter of less than 100 μm, and the aerogel fiber has an aspect ratio of more than 100.

An embodiment of the present application also provides use of the above-mentioned aerogel fiber in the high-tech industrial fields of textiles, chemical industry, environment or energy.

Compared with the prior art, the present application has the advantages:

1) Different from the traditional rigorous gel control method, the blow spinning method for preparing the aerogel fiber provided in the present application does not have high requirements on the gel process of aerogel materials and can be used for preparing the aerogel fiber after the spinning solution meeting the rheological conditions is obtained, avoiding the influence of the inadequate gel process on fiber properties. The prepared aerogel fiber has a unique three-dimensional porous network structure, extremely low thermal conductivity, high specific surface area, high porosity, certain spinnability and excellent skeleton structure stability, and can be applied to the fields of textiles and the like.
2) The blow spinning method for preparing the aerogel fiber provided in the present application solves the influence of destructive post-processing on the performance of the aerogel fiber in the prior art, improves the production efficiency of the aerogel fiber, greatly simplifies the process in general, and has great potential for industrial application.

BRIEF DESCRIPTION OF THE DRAWINGS

In order to provide a clearer explanation of the embodiments or technical solutions in the present application, a brief introduction will be given to the accompanying drawings required in the embodiments or description of the prior art. It is evident that the accompanying drawings in the following description are only some of the embodiments recorded in the present application. For ordinary technical personnel in the art, other accompanying drawings can be obtained based on these drawings without any creative effort.

DETAILED DESCRIPTION OF THE EMBODIMENTS

Figure 1:
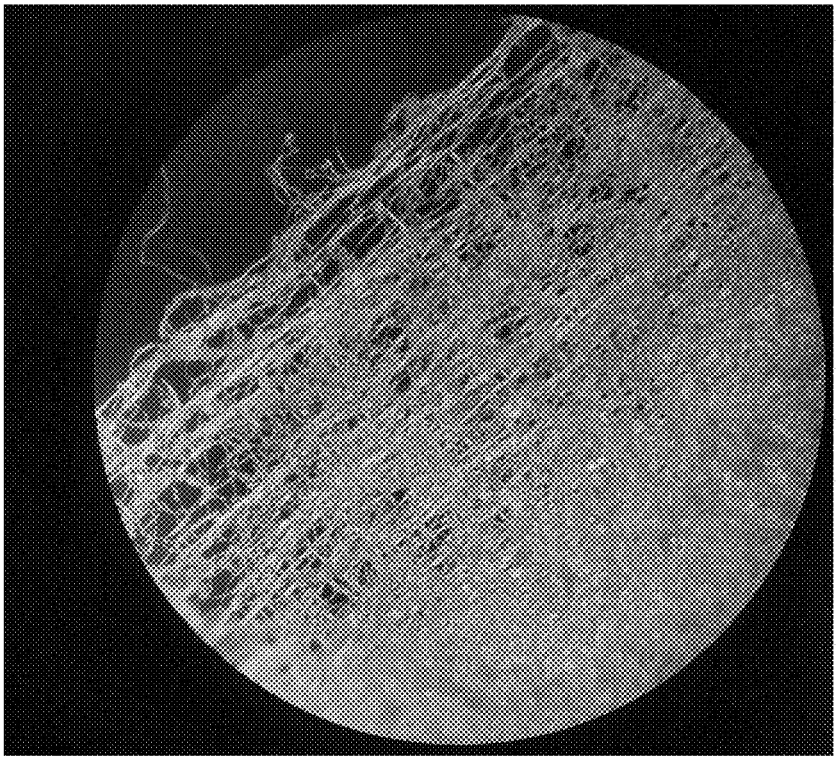
FIG. 1 is an optical microscope picture of an aerogel fiber obtained in example 1 of the present application.

In view of the defects in the prior art, the inventor of this case puts forward the technical solution of the present application after long-term research and a lot of practice, which mainly provides a new method for preparing an aerogel fiber by blow spinning.

The inventor of this case considers that the existing aerogel fiber preparation technology requires post-processing such as spinning and weaving of aerogel fiber filament. In view of the complex mesoporous structure inside the aerogel fiber, the structure and properties of the aerogel fiber are often damaged when the aerogel fiber is prepared into textiles by complex spinning, weaving and other processing technologies. Therefore, the present application has modified the blow spinning technology, retained its technical feature of a jet flow formed by air draft, and added the sol-gel transition process, so that the blow spinning can obtain stable and uniform gel fibers, and further obtain the airflow fibers by a drying technological means. The aerogel products obtained by this technology can be directly applied in the form of non-woven fabrics, flocs, etc., thereby avoiding the damage of the structure of the aerogel fiber in processing.

Next, this technical solution, its implementation process and principle and the like will be further explained and illustrated.

A preparation method of an aerogel fiber provided by one aspect of the embodiment of the present application comprises:

mixing a solvent with a polymer material to form a spinning solution;

driving the spinning solution with a high-speed airflow by using a blow spinning technology to form a jet flow, and forming a gel fiber through sol-gel transition; and performing solvent replacement on the gel fiber and then performing drying treatment to prepare the aerogel fiber.

In some specific embodiments, the preparation method of the aerogel fiber mainly comprises the following three steps:

1) a blow spinning step: preparing sol having a certain rheological behavior (i.e., spinning solution), driving the spinning solution using a high-speed airflow to form a stable jet flow (also called "sol fiber");
2) a dynamic sol-gel transition step: achieving the transition of a sol jet flow into gel under the condition of movement so that the sol jet flow becomes a gel fiber;
3) a special drying step: performing solvent replacement on the gel fiber, followed by using a special drying technology to allow the gel fiber to become an aerogel fiber under the condition of shrinking as much as possible or shrinking as little as possible.

In some embodiments, the spinning solution comprises sol-state, semigel-state or high-viscosity solutions.

Further, the spinning solution has a viscosity ranging from 80 to 4000 cp and a concentration of 0.1-30 wt %.

In some embodiments, the main composition materials of the spinning solution comprise an organic solvent and a polymer material. Where, the solvent comprises any one or a combination of more than two of nonvolatile dimethyl formamide (DMF), dimethylsulfoxide (DMSO), N-methylpyrrolidone (NMP), water and the like and substances with similar properties, but are not limited thereto. The present application adopts a nonvolatile solvent, which ensures that the gel fiber is not shrunk. Compared with other volatile solvents, the obtained fiber is the gel fiber.

Further, the polymer material comprises a nature polymer and/or synthesized polymer material and the like, preferably any one or a combination of more than two of polymers such as polyamide (such as poly(p-phenylenediamine), polyester (such as poly(methyl methacrylate), poly(dimethyl terephthalate), cellulose (such as hydroxycellulose), polyolefin polymer materials (such as polyvinyl alcohol) and polysiloxane, but is not limited thereto.

In some embodiments, the blow spinning technology refers to a method where a high-speed airflow is used to act on a spinning solution to form a polymer jet flow which forms a continuous gel fiber during the flight or forms the gel fiber after forming the semi-continuous gel fiber on a collection device.

In some embodiments, the blow spinning technology in the preparation method specifically comprises: using a spinneret plate as a spinning solution outlet whose spinneret opening has an opening number of 1-500 and has a diameter of 0.07-3 mm, and tapping around the spinneret opening by using the blow spinning technology to form an airflow channel so that airflow fully drafts the spinning solution (i.e., spinning sol) to form a jet flow.

Wherein, the airflow is dried air, or a mixed airflow of dried air and vapor (i.e., gel factor), with an air pressure of 0.1-5 MP; the vapor comprises any one of or a combination of more than two of water vapor, alcohol vapor, hydrochloric acid, ammonia gas and acetone vapor, and the volume ratio of the vapor in the mixed airflow is 0-60%.

In some embodiments, the preparation method specifically comprises: the jet flow autonomously undergoes sol-gel transition during the flight; or, the spinning solution (i.e., spinning sol) undergoes sol-gel transition after coming into contact with the vapor as a gel factor distributed in a jet flow flight space; or, after arriving at a receiving device, the jet flow of the spinning solution undergoes sol-gel transition by using any one of dipping, irradiation and temperature rising to form the gel fiber.

Further, the dipping time is within 3 h, until the complete gel is formed. The irradiation is carried out using ultraviolet light, without power requirement, until complete gel is formed, and the irradiation time is within 3 h. The temperature of temperature rising is more than 80° C., and the temperature is maintained within 3 h.

In some embodiments, the solvent used for solvent replacement comprises any one of or a combination of more than two of water, tert-butanol, ethanol, acetone and n-hexane, and the times of solvent replacement is 3-8 times.

Specifically, when subsequent drying treatment uses vacuum freeze-drying, solvent replacement can use water, tert-butanol, or a mixture of water and tert-butanol (such as 25% aqueous solution of tert-butanol); when subsequent drying treatment uses supercritical drying, solvent replacement can use ethanol, acetone or a combination of ethanol and acetone; when subsequent drying treatment uses ambient pressure drying, solvent replacement can use n-hexane.

In some embodiments, the drying treatment can use any one of or a combination of more than two of supercritical drying, vacuum freeze-drying, and ambient pressure drying.

Further, the supercritical drying comprises: replacing an organic solvent inside the gel fiber by using supercritical fluid under the supercritical condition to obtain the aerogel fiber. Wherein, the supercritical fluid comprises any one of or a combination of more than two of supercritical $CO_2$, supercritical methanol and supercritical ethanol, but is not limited thereto.

Further, the vacuum freeze-drying comprises: performing freezing crystallization treatment on the gel fiber at a low temperature (−10° C. to −20° C.) for 8-24 h, and then performing sublimation treatment under the conditions that a cold trap temperature is −80 to −45° C. and a vacuum degree is 0.1 kPa, so as to obtain the aerogel fiber.

Further, the ambient pressure drying comprises: directly removing the organic solvent inside the gel fiber to obtain the aerogel fiber.

In summary, the method for preparing the aerogel fiber by using blow spinning provided by the present application is a universal method. Different from the harsh gel control of the traditional method, this method has relatively low requirements on a gelation process of an aerogel material, and can achieve the preparation of the aerogel fiber by using this method after the spinning solution meeting rheological conditions is obtained, thereby avoiding that the gelation process does not sufficiently affect the performance of the fiber. Meanwhile, this method solves the influence of destructive post-processing required by the existing technology on the performance of the aerogel fiber while promoting the production efficiency of the aerogel fiber. Generally speaking, this method greatly simplifies the procedures, and has significant industrialization application prospect.

Another aspect of the embodiment of the present application also provides the aerogel fiber prepared by the preceding preparation method.

In some embodiments, the main materials of the aerogel fiber are nature polymer and/or synthesized polymer materials, preferably, any one or a combination of more than two of polyamide, cellulose, polyether, polyolefin polymer materials, graphene, carbon nanotubes, silicon dioxide, but are not limited thereto.

Further, the aerogel fiber is macroscopically distributed in a mesh or flocculent form, the aerogel fiber is a porous material, and the network is composed of micropores with a pore size of less than 2 nm, mesopores with a pore size of 2-50 nm and macropores with more than 50 nm.

Further, the aerogel fiber has a porosity of 60%-99% and a specific surface area of 10-2000 $m^2/g$; the aerogel fiber has a diameter of less than 100 μm and an aspect ratio of more than 100.

Compared with wet-process spinning, the aerogel fiber obtained by the present application has the advantages of promoted preparation efficiency and obviously reduced fiber diameter, so that the fiber is softer to bring optimized hand feel, and can be better applied to the field of textiles.

To sum up, the aerogel fiber is a porous fiber, and has the characteristics of high specific surface area, high porosity, low heat conductivity, certain spinnability and excellent skeleton structure stability and the like, and can be applied to the fields of textiles and the like.

Another aspect of the embodiment of the present application also provides the use of the aerogel fiber in the high-tech industrial fields of textiles, chemical industry, environment or energy and the like.

Next, the technical solution of the present application will be further illustrated in detail through several embodiments in combination with drawings. However, the selected examples are not only for explaining the technical solution of the present application, but not limiting the scope of the present application. Thus, specific functional details disclosed herein should not be explained as being limiting, but only as the basis of the claims and used to teach technical personnel in the field to adopt the representative basis of this application in different ways in any appropriate detailed embodiment in fact.

Example 1

Figure 2:
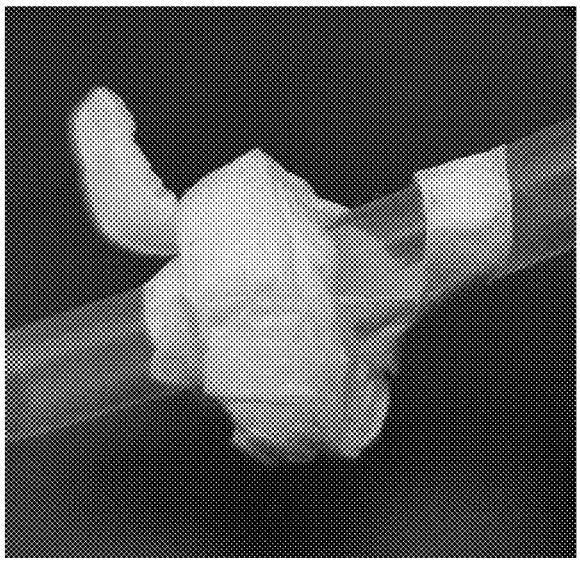
FIG. 2 is a physical picture of an aerogel fiber obtained in example 1 of the present application.
Figure 3:
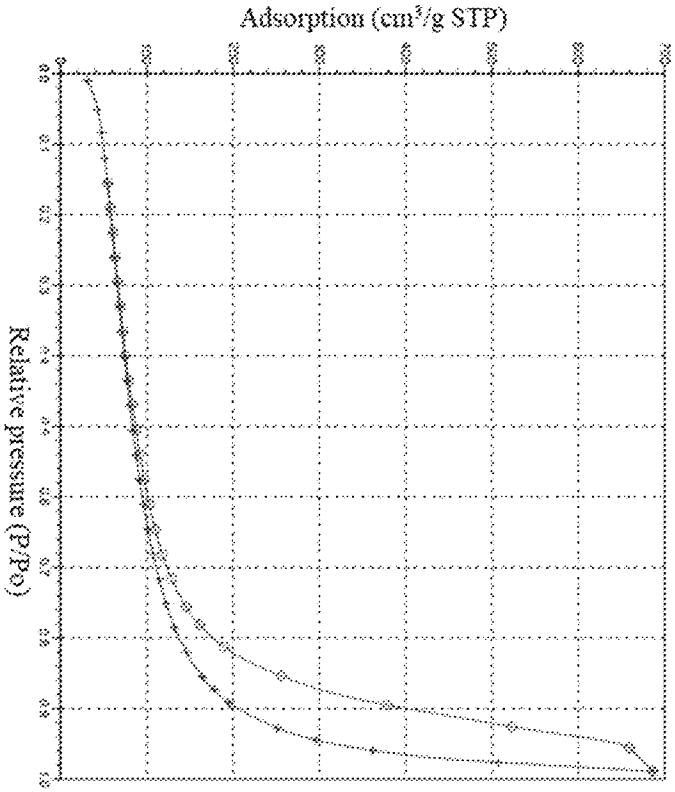
FIG. 3 is a nitrogen adsorption desorption curve graph of an aerogel fiber obtained in example 1 of the present application.

(1) Poly-p-phenylene terephthamide was dissolved into DMSO, and the concentration of the solution was adjusted so that the viscosity of the solution reached 1000 cp, as a spinning solution, the concentration of the spinning solution was 3.8 wt %;

(2) the spinning solution was pumped to a spinning nozzle through a pressure pump, the number of spinneret openings was 10, a diameter of the spinneret opening was 0.3 mm, a mixed vapor of dried air and ethanol vapor was used as an air source, an airflow valve was opened to form a high-pressure airflow, a volume ratio of dried air to ethanol vapor was adjusted to 4:1, a total air pressure was 1.3 MPa, until a stable jet flow was formed, and the jet flow autonomously underwent sol-gel transition during the flight to form a gel fiber;

(3) solvent replacement was performed on the above-mentioned gel fiber for 6 times with water as a replacement solvent;

(4) the above-mentioned hydrogel fiber was frozen for 8 hours at −12° C. and then put in a vacuum freeze dryer to undergo sublimation treatment under the conditions of a cold trap temperature of −80° C. and a vacuum degree of less than 0.1 kPa, drying until no solvent component is present in the fiber. The optical microscope picture of the obtained aerogel fiber is seen in FIG. 1, the physical image is seen in FIG. 2, the BET test graph of the obtained aerogel fiber is seen in FIG. 3, and other parameters are seen in Table 1.

Example 2

Figure 4:
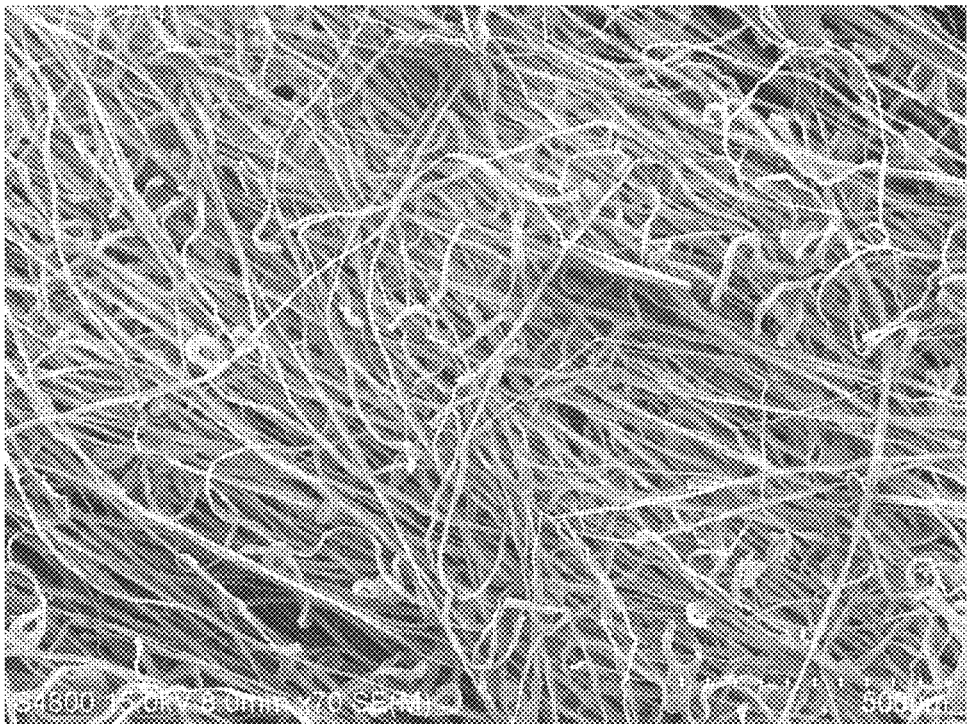
FIG. 4 is a scanning electron microscope (SEM) picture of an aerogel fiber obtained in example 2 of the present application.

(1) Polymethyl methacrylate and hydroxycellulose were dissolved into DMF, and the concentration of the solution was adjusted so that the viscosity of the solution reached 1000 cp, as a spinning solution, the concentration of the spinning solution was 5.1 wt %;

(2) the spinning solution was pumped to a spinning nozzle through a pressure pump, the number of spinneret openings was 1, a diameter of the spinneret opening was 0.07 mm, dried air was used as a high-pressure air source, an airflow valve was opened to form a high-pressure airflow, the pressure of the dried air was adjusted to 0.1 MPa until a stable jet flow was formed, and the jet flow underwent sol-gel transition using a dipping manner (within 3 h) after reaching the surface of a receiving device to form a gel fiber;

(3) solvent replacement was performed on the above-mentioned gel fiber for 5 times with water as a replacement solvent;

(4) the above-mentioned hydrogel fiber was frozen for 8 hours at −12° C. and then put in a vacuum freeze dryer to undergo sublimation treatment under the conditions of −45° C. and a vacuum degree of less than 0.1 kPa, drying until no solvent component is present in the fiber. The SEM image of the obtained aerogel fiber is seen in FIG. 4, and other parameters are seen in Table 1.

Example 3

(1) Polymethyl methacrylate was dissolved into NMP, and the concentration of the solution was adjusted so that the viscosity of the solution reached 1000 cp, as a spinning solution, the concentration of the spinning solution was 4 wt %;

(2) the spinning solution was pumped to a spinning nozzle through a pressure pump, the number of spinneret openings was 100, a diameter of the spinneret opening was 0.5 mm, a mixed vapor of dried air and hydrochloric acid vapor was used as a high-pressure air source, a volume ratio of dried air to hydrochloric acid vapor was 2:1, an airflow valve was opened to form a high-pressure airflow, a total air pressure was adjusted to 1.9 MPa, until a stable jet flow was formed, and the jet flow underwent sol-gel transition using a UV irradiation manner (within 3 h) after reaching the surface of a receiving device to form a gel fiber;

(3) solvent replacement was performed on the above-mentioned gel fiber for 8 times with ethanol as a replacement solvent;

(4) the above-mentioned gel fiber was dried in a supercritical $CO_2$ dryer until no solvent component is present in the fiber. The parameters of the obtained aerogel fiber are seen in Table 1.

Example 4

(1) Polyvinyl alcohol was dispersed into water, and the concentration of the solution was adjusted so that an injectable gel state was formed, as a spinning solution, and the spinning solution had a concentration of 0.1 wt % and a viscosity of 80 cp;

(2) the spinning solution was pumped to a spinning nozzle through a pressure pump, the number of spinneret openings was 500, a diameter of the spinneret opening was 0.7 mm, a mixed vapor of dried air and acetone vapor was used as an air source, an airflow valve was opened to form a high-pressure airflow, a volume ratio of dried air to acetone vapor was adjusted to 4:1, a total air pressure was adjusted to 1.3 MPa, until a stable jet flow was formed, and the spinning solution underwent sol-gel transition after coming into contact with the acetone vapor as a gel factor scattered in a jet flow flight space to form a gel fiber;

(3) solvent replacement was performed on the above-mentioned gel fiber for 3 times with water as a replacement solvent;

(4) the above-mentioned hydrogel fiber was frozen for 10 hours at −20° C. and then put in a vacuum freeze dryer to undergo sublimation treatment under the conditions of a cold trap temperature of −60° C. and a vacuum degree of less than 0.1 kPa, drying until no solvent component is present in the fiber. The parameters of the obtained aerogel fiber are seen in Table 1.

Example 5

(1) Polyvinyl alcohol and dimethyl terephthalate were dispersed into DMSO, and the concentration of the solution was adjusted so that an injectable gel state was formed, as a spinning solution, the concentration of the spinning solution had a concentration of 15 wt % and a viscosity of 4000 cp;

(2) the spinning solution was pumped to a spinning nozzle through a pressure pump, the number of spinneret openings was 10, a diameter of the spinneret opening was 3 mm, a mixed vapor of dried air and acetone vapor was used as an air source, an airflow valve was opened to form a high-pressure airflow, a volume ratio of dried air to acetone vapor was adjusted so that the ratio of acetone gas reached 60%, a total air pressure reached 5 MPa, until a stable jet flow was formed, and the jet flow underwent sol-gel transition using a manner of heating to 80° C. (the temperature was maintained within 3 h) after reaching the surface of a receiving device to form a gel fiber;

(3) solvent replacement was performed on the above-mentioned gel fiber for 6 times with cyclohexane as a replacement solvent; and (4) the above-mentioned gel fiber was dried at 80° C. at normal pressure until no solvent component was present. The parameters of the obtained aerogel fiber are seen in Table 1.

Example 6

(1) Polyvinyl alcohol and tetraethyl orthosilicate were dissolved into DMSO, and the concentration of the solution was adjusted so that the viscosity of the solution reached 2000 cp, as a spinning solution, the concentration of the spinning solution was 30 wt %;
(2) the spinning solution was pumped to a spinning nozzle through a pressure pump, the number of spinneret openings was 100, a diameter of the spinneret opening was 0.07 mm, a mixed vapor of dried air and ammonia gas was used as an air source, an airflow valve was opened to form a high-pressure airflow, a volume ratio of dried air to ammonia gas was adjusted to 1:1, a total air pressure reached 1.3 MPa, until a stable jet flow was formed, and the jet flow autonomously underwent sol-gel transition during the flight to form a gel fiber;
(3) solvent replacement was performed on the above-mentioned gel fiber for 5 times with cyclohexane as a replacement solvent; and
(4) the above-mentioned gel fiber was dried at 80° C. at the atmospheric pressure until no solvent component was present. The parameters of the obtained aerogel fiber are seen in Table 1.

Example 7

(1) Poly-p-phenylene terephthamide was dissolved into DMSO, and the concentration of the solution was adjusted so that the viscosity of the solution reached 1000 cp, as a spinning solution, the concentration of the spinning solution was 3.8 wt %;
(2) the spinning solution was pumped to a spinning nozzle through a pressure pump, the number of spinneret openings was 10, a diameter of the spinneret opening was 0.3 mm, a mixed vapor of dried air and water vapor was used as an air source, an airflow valve was opened to form a high-pressure airflow, a volume ratio of dried air to water vapor was adjusted so that the ratio of water vapor reached 15%, a total air pressure was 1.3 MPa, until a stable jet flow was formed, and the jet flow autonomously underwent sol-gel transition during the flight to form a gel fiber;
(3) solvent replacement was performed on the above-mentioned gel fiber for 4 times with water as a replacement solvent;
(4) the above-mentioned hydrogel fiber was frozen for 24 hours at −10° C. and then put in a vacuum freeze dryer to undergo sublimation treatment under the conditions of a cold trap temperature of −50° C. and a vacuum degree of less than 0.1 kPa, drying until no solvent component is present in the fiber. The parameters of the obtained aerogel fiber are seen in Table 1.

Comparative Example 1 (a Low-Boiling-Point Volatile Solvent was Used in a Spinning Solution)

(1) Polyethylene and tetraethoxysilane were dissolved into ethanol, and the concentration of the solution was adjusted so that the viscosity reached 1500 cp, as a spinning solution;
(2) the spinning solution was pumped to a spinning nozzle through a pressure pump, a mixed vapor of dried air and ammonia gas was used as an air source, an airflow valve was opened to form a high-pressure airflow, a volume ratio of dried air to ammonia gas was adjusted to 1:1, a total air pressure reached 1.3 MPa, until a stable jet flow was formed;
(3) solvent replacement was performed on the above-mentioned gel fiber with cyclohexane as a replacement solvent;
(4) the above-mentioned fiber was dried at 80° C. at atmospheric pressure until no solvent component was present. The fiber was obviously shrunk. By test, there was no pore structure, and other parameters are seen in Table 1.

Comparative Example 2 (No Sol-Gel Process)

(1) Polymethyl methacrylate and hydroxycellulose were dissolved into DMSO, and the concentration of the solution was adjusted so that the viscosity reached 1000 cp, as a spinning solution;
(2) the spinning solution was pumped to a spinning nozzle through a pressure pump, dried air was used as a high-pressure air source, an airflow valve was opened to form a high-pressure airflow, the pressure of air was adjusted to 0.8 MPa, until a stable jet flow was formed, and a liquid thin flow was formed on the surface of the receiving device;
(3) solvent replacement was performed on the above-mentioned gel fiber with water as a replacement solvent;
(4) the above-mentioned hydrogel fiber was frozen for 8 hours at −12° C., and then dried in a vacuum freezing-drier until no solvent component was present in the fiber. This fiber did not form an aerogel pore structure, and had extremely low specific surface area. Other parameters are seen in Table 1.

TABLE 1

Various parameters of fibers obtained in examples 1-7 and comparative examples 1-2

| Item | Average diameter (μm) | Specific surface area ($m^2/g$) | Pore volume ($cm^3/g$) | Elongation at break % | Elasticity modulus (MPa) |
|---|---|---|---|---|---|
| Example 1 | 1.8 | 220 | 0.24 | 14 | 4.6 |
| Example 2 | 2.2 | 250 | 0.52 | 20 | 5.8 |
| Example 3 | 1.5 | 270 | 0.32 | 11 | 2.3 |
| Example 4 | 2.2 | 140 | 0.15 | 35 | 7.6 |
| Example 5 | 2.0 | 160 | 0.25 | 21 | 4.5 |
| Example 6 | 1.9 | 110 | 0.11 | 43 | 3.2 |

TABLE 1-continued

Various parameters of fibers obtained in examples 1-7 and comparative examples 1-2

| Item | Average diameter (μm) | Specific surface area ($m^2/g$) | Pore volume ($cm^3/g$) | Elongation at break % | Elasticity modulus (MPa) |
|---|---|---|---|---|---|
| Example 7 | 1.7 | 210 | 0.23 | 16 | 4.7 |
| Comparative example 1 | 0.3 | 11 | No | 8 | 23 |
| Comparative example 2 | 1.5 | 17 | No | 7 | 2.1 |

It can be seen through examples 1-7 that the aerogel fiber obtained by the technical solution of the present application has a porous structure, high porosity and excellent skeleton structure stability; and the preparation method is simple in preparation process, mild in reaction condition, low in energy consumption, and is suitable for large-scale production.

In addition, the inventor of this case also conducted experiments with other raw materials and conditions listed in the specification by referring to the methods in example 1-example 7, and also produced an aerogel fiber with a unique porous structure and excellent skeleton structure stability.

It should be understood that the above-mentioned descriptions are only some embodiments of the present application. It should be pointed out that other modifications and improvements can be also made by ordinary skill in the art without departing from the creative concept of the present application, all of which fall within the scope of protection of the present application.

What is claimed is:

1. A preparation method of an aerogel fiber, comprising:

mixing a solvent with a polymer material to form a spinning solution;

driving the spinning solution with an airflow by using a blow spinning technology to form a jet flow, and forming a gel fiber through a sol-gel transition; and performing a solvent replacement on the gel fiber and then performing a drying treatment to prepare the aerogel fiber, wherein the preparation method further comprises: using a spinneret plate as a spinning solution outlet, wherein a spinneret opening of the spinning solution outlet has an opening number of 1-500 and a diameter of 0.07-3 mm, and tapping around the spinneret opening to form an airflow channel so that the airflow drafts the spinning solution to form the jet flow; wherein the airflow is dried air, or a mixed airflow of dried air and vapor, with an air pressure of 0.1-5 MPa; the vapor comprises one or a combination of more than two of water vapor, alcohol vapor, hydrochloric acid, ammonia gas, and acetone vapor.

2. The preparation method according to claim 1, wherein the spinning solution comprises a sol-state, semigel-state or high-viscosity solution; and/or the spinning solution has a viscosity of 80-4000cp and a concentration of 0.1-30 wt %.

3. The preparation method according to claim 1, wherein the solvent comprises one or a combination of more than two of dimethyl formamide (DMF), dimethylsulfoxide (DMSO), N-methylpyrrolidone (NMP), and water.

4. The preparation method according to claim 1, wherein the polymer material comprises natural polymer and/or synthetic polymer materials, and the polymer material comprises one or a combination of more than two of polyamides, polyesters, celluloses, polyolefin polymer materials, and polysiloxanes.

5. The preparation method according to claim 1, wherein a volume ratio of the vapor in the mixed airflow is 0-60%.

6. The preparation method according to claim 1, wherein the jet flow autonomously undergoes the sol-gel transition during a flight; or, the spinning solution undergoes the sol-gel transition after coming into contact with vapor as a gel factor distributed in a jet flow flight space; or, after arriving at a receiving device, the jet flow of the spinning solution undergoes the sol-gel transition by using one of dipping, irradiation, and temperature rising to form the gel fiber.

7. The preparation method according to claim 6, wherein a dipping time is within 3 h, the irradiation is carried out using an ultraviolet light, an irradiation time is within 3 h, a temperature of the temperature rising is more than 80° C., and the temperature is maintained within 3 h.

8. The preparation method according to claim 1, wherein the solvent used for the solvent replacement comprises one or a combination of more than two of water, tert-butanol, ethanol, acetone, and n-hexane, and times of the solvent replacement is 3-8 times.

9. The preparation method according to claim 1, wherein the drying treatment comprises one of or a combination of more than two of supercritical drying, vacuum freeze-drying, and ambient pressure drying.

10. The preparation method according to claim 9, wherein the supercritical drying comprises: replacing an organic solvent inside the gel fiber by using a supercritical fluid under a supercritical condition to obtain the aerogel fiber; and the supercritical fluid comprises one or a combination of more than two of supercritical $CO_2$, supercritical methanol, and supercritical ethanol.

11. The preparation method according to claim 9, wherein the vacuum freeze-drying comprises: performing a freezing crystallization treatment on the gel fiber at −10° C. to −20° C. for 8-24 h, then performing a sublimation treatment under conditions of a cold trap temperature being −80 to −45° C. and a vacuum degree being 0.1 kPa, to obtain the aerogel fiber.

12. The preparation method according to claim 9, wherein the ambient pressure drying comprises: directly removing an organic solvent inside the gel fiber to obtain the aerogel fiber.

13. The preparation method according to claim 1, wherein the aerogel fiber is a porous material with a porosity of 60%-99% and a specific surface area of 10-2000 $m^2/g$; the aerogel fiber has a diameter of less than 100 μm, the aerogel fiber has an aspect ratio of more than 100, and a pore structure inside the aerogel fiber is composed of micropores with a pore size of less than 2 nm, mesopores with a pore size of 2-50 nm, and macropores with a pore size of more than 50 nm.

14. A preparation method of an aerogel fiber, comprising:

mixing a solvent with a polymer material to form a spinning solution;

driving the spinning solution with an airflow; and performing a solvent replacement on the gel fiber and then performing a drying treatment to prepare the aerogel fiber, wherein the preparation method further comprises: using a spinneret plate as a spinning solution outlet, wherein a spinneret opening of the spinning solution outlet has an opening number of 1-500 and a diameter of 0.07-3 mm, and tapping around the spinneret opening to form an airflow channel so that the airflow drafts the spinning solution to form the jet flow; wherein the airflow is dried air, or a mixed airflow of dried air and vapor, with an air pressure of 0.1-5 MPa; the vapor comprises one or a combination of more than two of water vapor, alcohol vapor, hydrochloric acid, ammonia gas, and acetone vapor, wherein the spinning solution comprises a sol-state, semi-gel-state or high-viscosity solution; and/or the spinning solution has a viscosity of 80-4000cp and a concentration of 0.1-30 wt %.

15. A preparation method of an aerogel fiber, comprising:

mixing a solvent with a polymer material to form a spinning solution;

forming a jet flow, and forming a gel fiber through a sol-gel transition; and performing a solvent replacement on the gel fiber, wherein the preparation method further comprises: using a spinneret plate as a spinning solution outlet, wherein a spinneret opening of the spinning solution outlet has an opening number of 1-500 and a diameter of 0.07-3 mm, and tapping around the spinneret opening to form an airflow channel so that the airflow drafts the spinning solution to form the jet flow; wherein the airflow is dried air, or a mixed airflow of dried air and vapor, with an air pressure of 0.1-5 MPa; the vapor comprises one or a combination of more than two of water vapor, alcohol vapor, hydrochloric acid, ammonia gas, and acetone vapor, wherein the spinning solution comprises a sol-state, semi-gel-state or high-viscosity solution; and/or the spinning solution has a viscosity of 80-4000cp and a concentration of 0.1-30 wt %.

* * * * *